United States Patent [19]

Kay

[11] Patent Number: 4,720,016

[45] Date of Patent: Jan. 19, 1988

[54] CLOSET STORAGE SYSTEM

[76] Inventor: Harold Kay, 20 Point of Woods Dr., North Brunswick, N.J. 08902

[21] Appl. No.: 838,155

[22] Filed: Mar. 10, 1986

[51] Int. Cl.[4] ..... A47F 5/08

[52] U.S. Cl. ..... 211/96; 211/103; 211/175

[58] Field of Search ..... 211/96, 87, 103, 175, 211/168

[56] References Cited

U.S. PATENT DOCUMENTS

| | | | |
|---|---|---|---|
| 1,097,755 | 5/1914 | Goldsmith | 211/96 X |
| 1,359,012 | 7/1919 | Yates . | |
| 2,031,718 | 2/1936 | Kress | 211/87 |
| 2,194,191 | 12/1939 | Wolf . | |
| 2,786,579 | 6/1953 | Wright . | |
| 2,825,469 | 4/1955 | Watkins et al. . | |
| 2,926,824 | 3/1960 | Clair . | |
| 3,118,544 | 1/1964 | Franklin . | |
| 3,199,464 | 8/1965 | Shook | 211/175 |
| 3,294,248 | 12/1964 | Olson . | |
| 3,561,607 | 2/1971 | Deeley . | |
| 3,640,494 | 2/1972 | Ruter . | |
| 3,825,127 | 7/1974 | Morrison et al. . | |
| 4,209,156 | 6/1980 | Kashden . | |
| 4,300,741 | 12/1981 | Kashden . | |

FOREIGN PATENT DOCUMENTS

| | | | |
|---|---|---|---|
| 207963 | 5/1957 | Australia . | |
| 305797 | 11/1968 | Sweden | 211/103 |
| 215652 | 5/1924 | United Kingdom . | |

*Primary Examiner*—Robert W. Gibson, Jr.
*Attorney, Agent, or Firm*—Parkhurst & Oliff

[57] ABSTRACT

A method and an apparatus for modifying a closet to optimize the storage space therein is disclosed. The apparatus consists of a bracket member and an extension member which are slidably adjustable to achieve a desired length. An E-clip is provided which can attach to either the brcket member, the extension member or both at the same time at a plurality of positions along the length thereof. The E-clip can be attached to standards. Therefore, standards can be attached to the wall of a closet at any convenient location. The E-clips can be adjusted on and secured to the bracket and extension member to attach the bracket and extension member to the standards either separately or together. A plurality of longitudinal hanger support members are provided which can pivotally extend from the bracket and extension members. A plurality of conventional hangers can be positioned on the longitudinal support members. Therefore, when clothes are positioned on the conventional hangers, the clothes can easily be pivotally adjusted in the closet for access thereto. Further, the closet can be easily modified to optimize the storage space therein through use of the closet storage system according to the invention.

21 Claims, 8 Drawing Figures

CLOSET STORAGE SYSTEM

BACKGROUND OF THE INVENTION

Conventional closets are provided with a bar which extends parallel to the floor and wall of the closet. The bar is generally secured at both ends thereof to walls of the closet and hangers are supported by hooks by the bar. This conventional arrangement fails to make efficient use of the space in the closet.

For example, if all short clothes, such as mens shirts, are positioned on hangers on the bar, two bars can be positioned, one on top of the other, in an ordinary closet. However, if long clothes, such as coats or dresses, are positioned on hangers on the bar, only one bar can be positioned in an ordinary closet. Since a conventional bar must be secured at both ends, if a combination of short and long clothes is positioned on the bar, as in typical closets, only one bar can be positioned in a closet. Thus, the space beneath the shorter items of clothing is wasted.

Furthermore, when many items of clothing are positioned on the bar, it is inconvenient to remove and insert clothes because the hooks of the hangers must slide on the bar. Often the removal and insertion of clothes causes nearby clothes to be wrinkled.

A system was proposed to solve the above problems. The proposed system involved screwing a base support member to a wall and having longitudinal hanger support bars extend from the base member, while this is an improvement over conventional closets, this is still inefficient because it was difficult to secure the base portion to the wall and once the base portion was secured to the wall it could not be easily moved. Further, the base was a standard size and could not easily be adjusted to suit various sizes of closets.

Furthermore, the hanger support members provided by the prior art have the hanger attached to the hanger support member or the hanger wedged onto the support member. Thus, hangers were very difficult to remove and insert into the closet and a plurality of hangers could not be supported by one support member.

SUMMARY OF THE INVENTION

This invention was developed in view of the foregoing background and to overcome the foregoing drawbacks. It is accordingly an object of the present invention to provide a closet system which makes efficient use of the space in a closet and also which makes it convenient to remove and insert clothes from a closet even if the closet is crowded.

It is a further object of the invention to provide a closet system which can be easily mounted in a closet and once mounted in the closet can be easily adjusted to various positions within the closet.

It is yet a further object of this invention to provide a closet system which includes a base member which can be easily adjusted in length to suit closets of various sizes.

It is still a further object of the invention to provide a hanger support member which makes it easy to insert and remove hangers from a closet and which can support a plurality of hangers.

To achieve the above objects, a closet system is provided which includes a bracket member and an extension member. The extension member is slidably adjustable within the bracket to form one continuous support member of varying lengths. Apertures are provided along the length of both the bracket and extension members. The bracket and extension member can be releasably fixed together at a plurality of positions, preferably by inserting a pin through corresponding apertures. Thus the length of the support member can easily be adjusted to suit closets of different sizes and shapes.

An E-clip is preferably provided, one side of which can easily be attached to the bracket or the extension member or to both at the same time at a plurality of positions along the length of the bracket or extension member. The other side of the E-clip can be attached to standards at various heights. The standards can be attached at convenient locations on the walls and, since the E-clip can be attached to the bracket and extension member at a plurality of positions along the length thereof, the position of the E-clip on the bracket can be adjusted to attach the E-clip to the standard. Thus, if it is desired to use screws to attach the standards, the standards can be screwed to the beams in the wall of the closet. Since these bracket and extension members can be attached to the E-clip which can be easily attached and removed from the standard, the bracket and extension bracket members can easily be securely attached or removed from different positions on a wall, either separately or together.

Further, to achieve the objects of the invention, a longitudinal hanger support member is provided. One end of the longitudinal hanger support member includes a structure which easily supports and allows hangers to freely move thereon. The other end of the hanger support member can easily be pivotally attached to the bracket or extension member or both at the same time at a plurality of positions. Advantageously, the hanger support member can be pivotally secured to the bracket and extension member by inserting a cylindrical end thereof into the apertures of the bracket and extension members. A plurality of hanger support members can be positioned along the length of the bracket and extension member. Since each of the hanger support members is pivotable, when items of clothing are positioned thereon the support members can be pivoted to allow easy access to clothing.

A closet can therefore easily be modified to make more efficient use of the space in the closet. The extension and bracket members can be mounted either separately or together on the standards at convenient heights. If they are mounted together the length of the standard can be adjusted to suit the surface on which it is mounted. Thus a first portion of the closet can advantageously support two levels of short clothing while a second portion of the same closet can support long clothing at one level. Thus, the storage space of the closet is maximized without requiring significant structural modifications to the closet.

BRIEF DESCRIPTION OF THE PREFERRED EMBODIMENTS

The above objects, features and advantages of the present invention will become more apparent from the description of the invention which follows, taken in conjunction with the accompanying drawings, wherein like reference numerals denote like elements, and wherein.

The present invention will be described in detail with reference to the accompanying drawings which illustrate a preferred embodiment according to the present invention.

DESCRIPTION OF THE PREFERRED EMBODIMENTS

Figure 1:
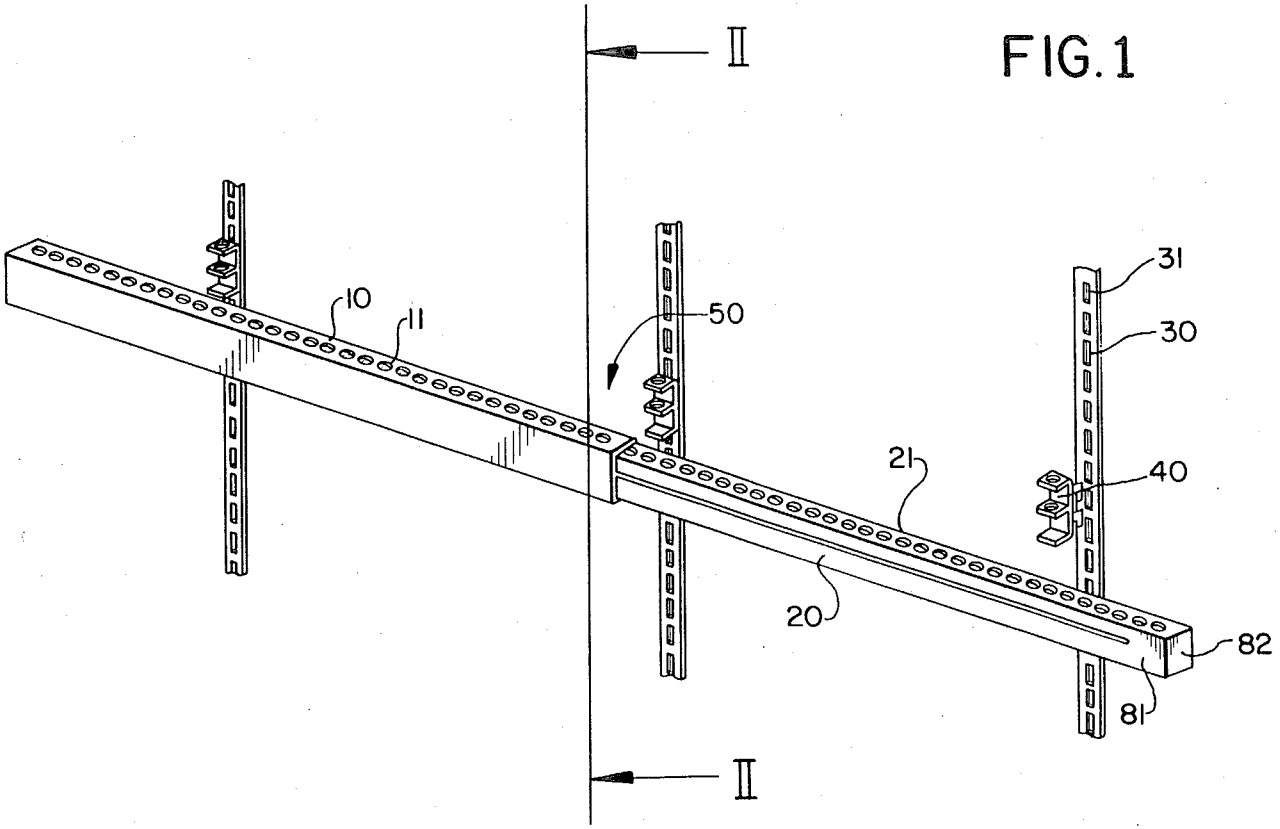
FIG. 1 shows a perspective view of the general closet system.

FIG. 1 illustrates the general closet system. The system includes bracket 10, extension member 20, E-clip 40 and standards 30. The standards 30 include a plurality of apertures 31 and can be attached to a wall using screws or other conventional means.

Figure 2:
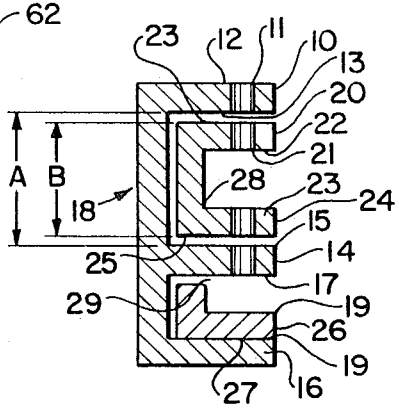
FIG. 2 shows a cross-sectional view along line II—II of FIG. 1 of an extension bracket member slidably inserted in the bracket member.
Figure 7:
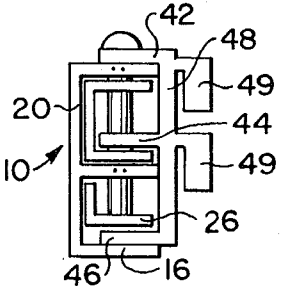
FIG. 7 shows a cross-sectional view of the E-clip as it is attached to a bracket and extension member together.
Figure 6:
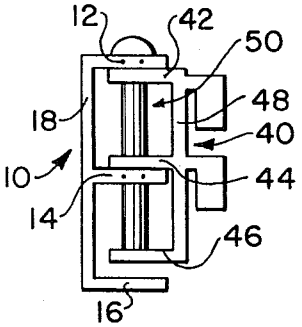
FIG. 6 shows a cross-sectional view of the E-clip as it is attached to the bracket member.

Bracket 10, as shown in FIGS. 2, 6 and 7, comprises a vertical member 18 with upper, middle and lower horizontal members 12, 14, 16 respectively, extending perpendicularly from the vertical member. Upper horizontal member 12 and middle horizontal member 14 include a plurality of apertures 11 extending therethrough. Each of the apertures in upper horizontal member 12 has a corresponding vertically aligned aperture in middle horizontal member 14. There are preferably no apertures in lower horizontal member 16.

Figure 3:
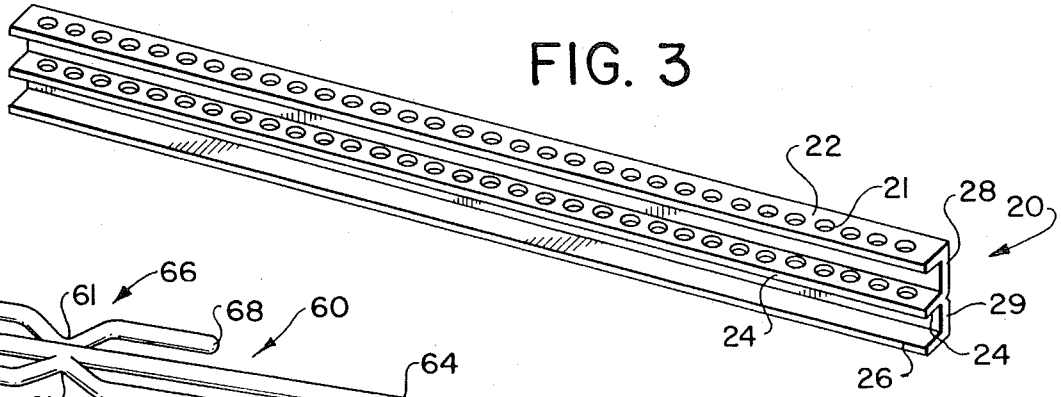
FIG. 3 shows a perspective view of an extension bracket member.

Extension member 20, as shown in FIGS. 1–3 includes a vertical portion 28 and upper, middle and lower horizontal portions 22, 24 and 26 respectively. Vertical portion 28 also includes a slot 29 which extends parallel to and below middle horizontal portion 24. Upper horizontal portion 22 and middle horizontal portion 24 have a plurality apertures 21 extending therethrough. Each aperture in upper horizontal portion 22 has a corresponding vertically aligned aperture in middle horizontal portion 24. There are preferably no apertures in lower horizontal portion 26.

Extension member 20 and bracket member 10 are constructed so that a distance A between a lower surface 13 of horizontal upper member 12 and an upper surface 15 of middle horizontal member 14 is greater than a distance B between an upper surface 23 of the upper horizontal portion 22 and a lower surface 25 of the middle horizontal portion 24 of the extension member 20. Also, slot 29 corresponds in width to the thickness of middle horizontal member 14 of bracket 10. The distance between the lower opening of slot 29 and the lower surface 27 of lower horizontal portion 26 is less than the distance between lower surface 17 of middle horizontal member 14 and upper surface 19 of lower horizontal member 16 of bracket 10. Therefore, extension member 20 can be positioned parallel to and inside of bracket 10 with the middle horizontal member 14 of bracket 10 extending through slot 29 of extension member 20. In this position vertical portion 28 will be parallel and adjacent to vertical member 18. This configuration allows extension member 20 to be slidable in the horizontal direction within bracket 10 but essentially non-movable in the vertical direction relative to bracket 10.

Figure 4:
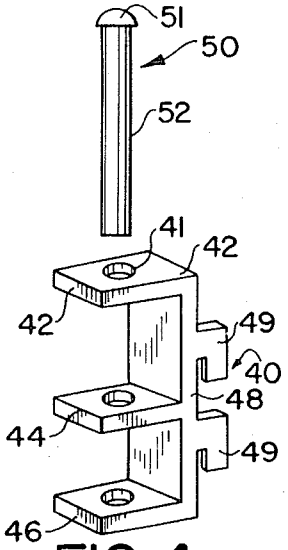
FIG. 4 shows a perspective view of E-clip and pin member and the cooperation therebetween.
Figure 8:
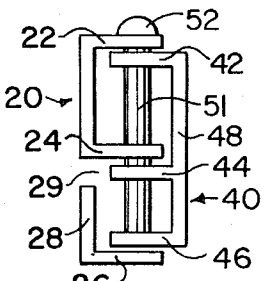
FIG. 8 shows a cross-sectional view of the E-clip as it is attached to the extension member.

A pin 50 is provided which has a body portion 52 and cap portion 51 as most clearly shown in FIGS. 1 and 4. The body portion 52 is slightly smaller in width than the diameter of apertures 11 in bracket 10 and apertures 21 in extension member 20. Therefore, the body portion 52 of pin 50 can be inserted through apertures 11 and 21 when apertures 11 and 21 are vertically aligned thereby locking extension member 20 to bracket 10. Cap member 51 is larger in diameter than the width of apertures 11 or 21 so that only the body portion 52 of pin 50 can extend through apertures 11 or 21.

Slot 29, as shown in FIGS. 1–3, extends in the longitudinal direction of vertical portion 28 for a large part of the length of portion 28. A surface 81 at the end of vertical portion 28 preferably does not include slot 29. Extension member 20 also includes a solid end portion 82 at one end thereof. Surface 81 and end portion 82 provide extra rigidity to extension member 20.

An E-clip 40 as most clearly shown in FIG. 4 is provided. E-clip 40 includes a vertical surface 48 and upper, middle and lower horizontal extension portions 42, 44 and 46 respectively, which are preferably substantially perpendicular to vertical surface 48. Each of the upper, middle and lower horizontal extension portions 42, 44 and 46 include an aperture 41. Extending from the opposite side of the vertical surface 48 from the horizontal extension portions are hook members 49. Hook members 49 are preferably provided at one side of vertical surface 48 to facilitate manufacturing of E-clip 40. Apertures 41 in E-clip 40 are approximately equal in diameter to apertures 11 in bracket 10 and apertures 21 in extension member 20. Therefore, the body 52 of pin 50 can extend through apertures 41.

E-Clip 40 is constructed as shown in FIG. 6 so that when the horizontal extension portions 42, 44, 46 of E-clip 40 are juxtaposed with the horizontal members 12, 14, 16 of bracket 10, the apertures 41 of E-clip 40 can be vertically aligned with the apertures 11 of bracket 10. Therefore, the pin 50 can be inserted through apertures 11 and 41 to secure E-clip 40 to bracket 10. In this juxtaposed relationship, the upper horizontal extension portion 42 is preferably positioned substantially parallel to, beneath, and in contact with horizontal member 12. Middle horizontal extension portion 44 is preferably positioned parallel to, above, and in contact with middle horizontal member 14. Lower horizontal extension portion 46 is preferably positioned above, parallel to, but spaced from lower horizontal member 16.

Similarly, when the horizontal extension portions 42, 44, 46 of E-clip 40 are juxtaposed with the horizontal portions 22, 24, 26 of extension member 20, the apertures 41 of E-clip 40 can be vertically aligned with the apertures 21 of extension member 20. Thus, pin 50 can be inserted through apertures 41 and 21 and can secure E-clip 40 to extension member 20. In this juxtaposed relationship, E-clip 40 is advantageously positioned so that upper horizontal extension portion 42 is beneath and substantially parallel to upper horizontal portion 22, middle horizontal extension portion 44 is beneath and substantially parallel to middle horizontal portion 24, and lower horizontal extension portion 46 is above and substantially parallel to lower horizontal portion 26.

Furthermore, when extension member 20 is placed within bracket 10 the horizontal extension portions 42, 44, and 46 of E-clip 40 can be juxtaposed with the horizontal portions 22, 24, 26 of extension member 20 and with the horizontal members 12, 14, 16 of bracket 10. Therefore, E-clip 40 can be secured to extension member 20 and bracket 10 at the same time, thereby also securing extension member 20 to bracket 10. In this juxtaposed relationship upper horizontal extension portion 42 is preferably above and parallel to upper horizontal member 12 which is above, and parallel to, horizontal portion 22. Middle horizontal extension portion 44 is above, and parallel to, middle horizontal extension 24, which is above, and parallel to, middle horizontal member 14. Lower horizontal extension portion 46 is above, and substantially parallel to, lower horizontal portion 26, which is above, and substantially parallel to lower horizontal member 16.

The hooks 49 which extend from the vertical surface 48 of E-clip 40 are adapted to easily attach E-clip 40 to standard 30 by protruding through apertures 31 and hooking onto the standard 30. Therefore, E-clip 40 can be attached to bracket 10, extension member 20, or both bracket 10 and extension member 20 together and can then be attached to the standard 30, which is mounted on a wall, thereby securing bracket 10 and/or extension member 20 to a wall.

Therefore, according to the present invention a single E-clip 40 can be secured to either the bracket 10, extension member 20 or both at the same time. This simplifies manufacture and makes production more economical since different attachment means do not have to be produced to mount the bracket 10 and extension member 20 on the standard 30.

Figure 5:
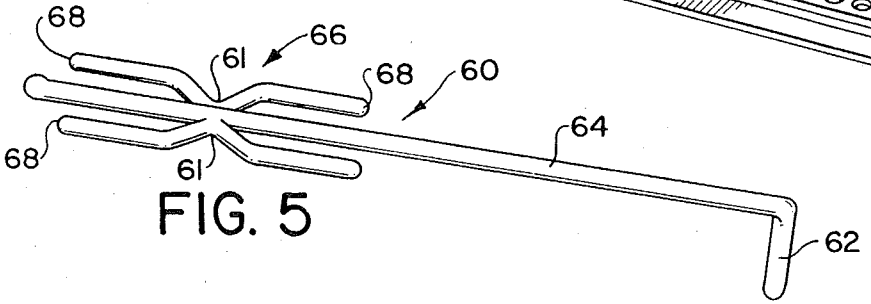
FIG. 5 shows a perspective view of a hanger support member.

FIG. 5 shows a hanger support member 60. The hanger support member 60 is provided with a vertical portion 62 and a longitudinal portion 64. The vertical portion 62 is of approximately the same width as the body 52 of pin 50. Therefore, the vertical portion 62 of hanger member 60 can easily fit into apertures 11 of bracket 10, apertures 21 of extension member 20, and apertures 41 of E-clip 40. Thus, the hanger support member can be pivotally supported by bracket 10 and extension member 20 and both at the same time.

Advantageously, therefore, the apertures 11 and 21 in bracket 10 and extension member 20 serve a triple function. First, the bracket 10 can be fixed to extension member 20 by inserting pin 50 through corresponding vertically aligned apertures. Second, the E-clip can be secured to bracket 10, extension member 20, or both by inserting pin 50 through corresponding vertically aligned apertures. Third, vertical portions 62 of hanger support members 60 are pivotally supported when inserted into corresponding vertically aligned apertures. Since all apertures have corresponding vertically aligned apertures, vertical portion 62 cannot move longitudinally and thus the longitudinal portion 64 of hanger support member 60 cannot move vertically.

Longitudinal member 64 has formation 66 at one end thereof. Formation 66 includes a plurality of parallel portions 68 and a plurality of connection portions 61. The connection portions 61 connect the parallel portions 68 to the longitudinal member 64 with a space provided therebetween. Connection portions 61 are preferably in a general V-shape with the apex of the "V" attached to the longitudinal member 64 and each end of the "V" attached to a parallel portion 68. Further, two connection portions 61 are preferably provided at the same longitudinal position on the longitudinal bar 64 at opposite sides thereof. The space between parallel portions 68 and longitudinal support member 64 enables hooks of conventional hangers to be supported on the connection members 64 between the parallel portion 68 and longitudinal bar 64. The hangers are thereby freely movable between the parallel portions 68 and longitudinal bar 64 on connection portion 61 but parallel portions 68 prevent the hangers from falling from the connection portion 61 during lateral movement of hanger support member 60. Advantageously, the parallel portions 68 are spaced far enough from the longitudinal portion 64 to permit a plurality (i.e. approximately 3 to 4) of conventional layers to be supported by connection portions 61 and to be freely movable thereon.

Bracket 10 and extension member 20 are each adapted to pivotally retain a plurality of hanger support members 60. Thus, when conventional hangers are supported by the hanger support members 60, the hanger support members 60 can be pivoted to allow easy access to the hangers.

The invention further contemplates the use of various other types of hangers with the bracket and extension member structure, for example, hangers having a hanger attached to the longitudinal bar.

Any or all of the structure of this invention can advantageously be coated by well known methods with well known materials to protect the structure. A coating of vinyl (e.g., polyvinyl chloride) could advantageously be used for this purpose.

It is also within the contemplation of the present invention to attach the E-clip to a shelf, either permanently or releasably, thereby enabling a shelf to be quickly and securely mounted in the closet by attaching the E-clip to the standards. Furthermore, by attaching hook members 49 to vertical member 48 at an angle, when a shelf is attached to the E-clip the shelf could be mounted in the closet at an angle. Such a shelf could be useful to hold shoes, etc. in the lower part of a closet.

Using the closet system of the present invention, therefore, a standard closet can be easily adapted to make more efficient use of the space in the closet. The conventional bar is first removed from the closet. Standards 30 are then mounted in the closet. Since the E-clip 40 can be used to mount the bracket 10 and extension member 20 to the standards 30 at various positions along the length of the bracket 10 or extension member 20, the standards 30 can be mounted at any convenient location in the closet. Generally, if screws are used to mount the standard 30, the standards are mounted along beams within the structure of the closet.

The E-clip 40 is then attached to the bracket 10 which is then mounted on the standard 40 at the desired height. The extension member 20 can be attached to the bracket 10 using pin 50, to extend the length of the support structure. Hanger support members 60 are then placed within apertures 11 and 21. Since the apertures 11 are in both upper horizontal member 12 and middle horizontal member 14, the vertical portion 62 of hanger support member 60 extends through two vertically aligned apertures, thus preventing undesirable vertical movement of longitudinal portion 64 of hanger support member 60. Similarly, since apertures 21 are in both upper horizontal portion 22 and middle horizontal portion 14, vertical portion 62 extends through two vertically aligned apertures thus preventing undesirable vertical movement of longitudinal member 64.

This invention therefore provides a closet system which can be easily mounted on a wall and easily moved after being mounted on the wall. The system is easily adaptable to various walls and therefore to closets in various sizes and shapes. The storage space in a closet can thus be optimized. The system includes a hanger support member which can easily support a variety of hangers and which can be easily mounted and removed therefrom.

While the present invention has been described in its preferred embodiments, it is to be understood that the invention is not limited thereto, and may be otherwise embodied within the scope of the following claims.

What is claimed is:

1. A closet storage system comprising:

a bracket;

an extension member; and a connection means for slidably engaging said bracket with said extension member, said bracket and said extension member being shaped so that said extension member is partially slidable within said bracket, said connection means being adapted to be secured to any one of said bracket, said extension member, and both of said bracket and said extension member together.

2. The closet storage system of claim 1, wherein said bracket comprises a first vertical portion and an upper, middle and lower horizontal member extending from said vertical portion, said upper and middle horizontal members each having a plurality of holes, each hole of the plurality of holes of said upper horizontal member being vertically aligned with a hole of said plurality of holes of said middle horizontal member.

3. The closet storage system of claim 2, wherein the extension member comprises a second vertical portion and an upper, middle and lower extension portion, said upper and middle extension portions each having a plurality of apertures, each aperture of the plurality of apertures of said upper extension portion being vertically aligned with a corresponding aperture of said plurality of apertures of said middle extension portion, said second vertical portion including a slot which extends parallel to said middle extension portion.

4. The closet storage system of claim 3, wherein a first distance between said upper and middle extension portions of said extension member is less than a second distance between the upper and middle horizontal members of said bracket, whereby said extension member can be placed within said bracket with said upper and middle horizontal members and said upper and middle extension portions extending in the same direction, said first vertical portion being adjacent to said second vertical portion, and said second horizontal member extending through said slot thereby enabling said extension member to slide in a horizontal direction within said bracket and all of said holes of said bracket to be vertically aligned with apertures of said extension member.

5. The closet storage system of claim 4, wherein said connection means comprises a clip including a vertical portion and a first, second and third protrusion, each of said first, second and third protrusions including a hole, said holes being substantially vertically aligned, said holes being approximately equal in diameter to said holes in said bracket and said apertures in said extension member, whereby when said clip is juxtaposed with said bracket, said holes of said clip can be aligned with one of said holes of said upper horizontal member and one of said holes of said middle horizontal member, and whereby when said clip is juxtaposed with said extension member said holes of said clip can be aligned with one of said apertures of said upper extension portion and one of said apertures of said middle extension portion.

6. The closet storage system of claim 5, further comprising a plurality of standards, each of said standards including a plurality of apertures.

7. The closet storage system of claim 5, wherein when said apertures of said extension member are vertically aligned with said holes of said bracket, said clip can be juxtaposed with both said bracket and said extension member so that said holes of said bracket, said apertures of said extension member and said holes of said clip can all be vertically aligned.

8. The closet storage system of claim 7, further comprising a pin including a cylindrical barrel portion and a cap portion, said barrel portion having a width slightly less in diameter than said diameter of said holes of said bracket, said apertures of said extension member, and said holes of said clip, wherein when said apertures of said extension member are aligned with said holes of said bracket, said pin can be inserted into said holes and apertures to secure said bracket to said extension member.

9. The closet storage system of claim 8, wherein when said holes of said clip are vertically aligned with said apertures of said extension member, said barrel of said pin can be inserted into said holes of said clip and said apertures to secure said clip to said extension member.

10. The closet storage system of claim 9, wherein when said holes of said clip are vertically aligned with said holes of said bracket member said pin can be inserted into said holes of said bracket member and said clip to secure said clip to said bracket member and wherein when said holes of said bracket are vertically aligned with said apertures of said extension member and said holes of said clip, said pin can be inserted into said holes of said bracket, said apertures of said extension member, and said holes of said clip to secure said bracket, said extension member and said clip together.

11. The closet storage system of claim 10, further comprising a hanger support member which includes:

a longitudinal member including a first end and a second end;

a vertical portion extending downward from said first end of said longitudinal member;

a support assembly attached to said second end, said support assembly functioning to support a plurality of hangers so that said hangers are freely movable on said support assembly.

12. The closet storage system of claim 11, wherein said vertical portion of said hanger support member is adapted to fit into said vertically aligned holes of said bracket member and said vertically aligned apertures of said extension member and to be pivotally supported thereby.

13. The closet storage system of claim 6, wherein said vertical portion of said clip includes a first side and a second side, said first, second and third protrusions extending from said first side, said second side including a first clip and a second clip, said first and second clip being adapted to be secured to said apertures of said standard.

14. A hanger support member comprising:

a longitudinal member including a first end and a second end;

a vertical portion extending downward from said first end of said longitudinal member;

a support assembly attached to said second end, said support assembly including a plurality of parallel portions and a plurality of connecting members, said longitudinal member, said plurality of connecting members, and said parallel portions all being in a horizontal plane, said support assembly functioning to support a plurality of hangers so that said hangers are freely movable on said support assembly.

15. The hanger support member of claim 14, wherein each of said plurality connecting members includes a central portion and two outer ends, each said connecting member being bent at said central portion, said central portion being attached to said longitudinal bar, each of said two outer ends being connected to one of said plurality of parallel portions, whereby said parallel portions are supported at a distance from said longitudinal bar so that hangers can be supported on said connecting members and be freely movable on said connecting members but be held on said connecting members by said parallel portions.

16. The hanger support member of claim 15, wherein two of said connecting members are attached to said longitudinal bar at the same longitudinal position on said bar on opposite sides thereof.

17. A method for increasing storage space in an area comprising:

mounting a bracket and an extension member on a surface in said area, adjusting a longitudinal length of a combination of said bracket and extension member in accordance with an amount of space in said area; and pivotally mounting hanger support members on said bracket and said extension member, whereby hangers can be supported on said pivotable support member and said hanger support members can be pivotally moved to access said hangers.

18. The method according to claim 17, wherein said surface comprises a wall and wherein standards are secured to said wall at a convenient place on said wall, said desired length of said bracket and extension members being greater than a distance between said standards, said bracket and extension members being locked at said desired length, said bracket and said extension members being secured to said standards and thereby being secured to said wall.

19. The method according to claim 18, wherein a connecting means is used to secure said bracket and said extension member to said standard, said connecting means being attachable to said bracket at a plurality of different positions and to said extension member at a plurality of different positions and to both said bracket and said extension member at once in at least one position.

20. An E-clip comprising:

a vertical surface including a first side and a second side;

a plurality of horizontal surfaces, each of said plurality of horizontal surfaces being parallel to another of said horizontal surfaces, each of said horizontal surfaces being attached to said first side of said vertical surface and including a hole therein; and at least one hook member which extends from said second side of said verticle surface.

21. The E-clip of claim 18, wherein said plurality of horizontal surfaces comprises three surfaces and said at least one hook member comprises two clips.

* * * * *